US011365750B2

(12) United States Patent
Wang et al.

(10) Patent No.: US 11,365,750 B2
(45) Date of Patent: Jun. 21, 2022

(54) TRAY-TYPE FAN IMPELLER STRUCTURE

(71) Applicant: ASIA VITAL COMPONENTS CO., LTD., New Taipei (TW)

(72) Inventors: Te-Chung Wang, New Taipei (TW); Ming-Che Lee, New Taipei (TW); Min-Sheng Cheng, New Taipei (TW); Liang-Hsuan Yeh, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 48 days.

(21) Appl. No.: 16/727,915

(22) Filed: Dec. 27, 2019

(65) Prior Publication Data

US 2021/0199123 A1 Jul. 1, 2021

(51) Int. Cl.

| | |
|---|---|
| ***F04D 29/38*** | (2006.01) |
| ***F04D 29/34*** | (2006.01) |
| ***F04D 29/54*** | (2006.01) |
| ***F04D 29/32*** | (2006.01) |
| ***F04D 19/00*** | (2006.01) |
| ***F04D 17/16*** | (2006.01) |
| ***F04D 29/66*** | (2006.01) |

(52) U.S. Cl.

CPC ..... *F04D 29/384* (2013.01); *F04D 17/161* (2013.01); *F04D 19/002* (2013.01); *F04D 29/329* (2013.01); *F04D 29/34* (2013.01); *F04D 29/542* (2013.01); *F04D 29/666* (2013.01)

(58) Field of Classification Search

CPC ..... F04D 29/384; F04D 29/329; F04D 29/34; F04D 29/542; F04D 29/666; F04D 17/08; F05D 2210/12

See application file for complete search history.

(56) References Cited

U.S. PATENT DOCUMENTS 7,455,504 B2 * 11/2008 Hill ..... F04D 29/281 416/179
8,322,980 B2 * 12/2012 Khanna ..... F04D 29/582 415/177

(Continued)

FOREIGN PATENT DOCUMENTS

CN 101463831 A 6/2009
CN 202209311 U 5/2012

(Continued)

OTHER PUBLICATIONS

Adams, Jake; "A trip down memory lane of needle wheel impellers"; Reef Builders https://reefbuilders.com/2014/12/12/trip-memory-lane-needle-wheel-impellers/ (Year: 2014).*

(Continued)

*Primary Examiner* — Kenneth Bomberg
*Assistant Examiner* — Ryan C Clark
(74) *Attorney, Agent, or Firm* — Bradley J. Thorson; DeWitt LLP

(57) ABSTRACT

A tray-type fan impeller structure includes a plate body annularly disposed around a hub. The plate body has a connection side connected with the hub and a free side extending in a direction away from the hub. Multiple boss bodies are arranged on a top face or the top face and a bottom face of the plate body at intervals. By means of the boss bodies, the periodical noise problem caused by the conventional blades is improved.

28 Claims, 20 Drawing Sheets

(56) References Cited

U.S. PATENT DOCUMENTS

| | | | | |
|---|---|---|---|---|
| 9,709,069 | B2 * | 7/2017 | Bosley | F04D 29/083 |
| 10,408,064 | B2 * | 9/2019 | Zuniga | F28F 13/12 |
| 10,974,992 | B2 * | 4/2021 | Grevain | F27B 7/2033 |
| 2007/0029498 | A1 * | 2/2007 | Davis | F04D 19/04 250/396 R |
| 2007/0140844 | A1 | 6/2007 | Yoshida | |
| 2012/0014779 | A1 * | 1/2012 | Gilliam | F04D 5/001 415/90 |
| 2016/0215798 | A1 * | 7/2016 | Gilliam | F04D 13/04 |

FOREIGN PATENT DOCUMENTS

| | | | |
|---|---|---|---|
| CN | 102954035 | A | 3/2013 |
| CN | 202926707 | U | 5/2013 |
| CN | 203516181 | U | 4/2014 |
| CN | 104329290 | A | 2/2015 |
| CN | 104454635 | A | 3/2015 |
| CN | 104806566 | A | 7/2015 |
| CN | 110486324 | A | 11/2019 |
| DE | 19531160 | A1 | 2/1997 |
| DE | 202011003839 | U1 | 7/2011 |
| JP | H08508806 | A | 9/1996 |
| TW | M553896 | | 1/2018 |
| TW | M592469 | | 3/2020 |

OTHER PUBLICATIONS

Search Report dated Apr. 1, 2020 issued by Taiwan Intellectual Property Office for counterpart application No. 108142985.

Search Report dated Sep. 18, 2020 issued by China National Intellectual Property Administration for counterpart application No. 2019111745190.

Search Report dated Jun. 4, 2021 issued by China National Intellectual Property Administration for counterpart application No. 2019111745190.

Search Report dated Jan. 26, 2022 issued by China National Intellectual Property Administration for counterpart application No. 2019111745190.

* cited by examiner

TRAY-TYPE FAN IMPELLER STRUCTURE

BACKGROUND OF THE INVENTION

1. Field of the Invention

The present invention relates generally to a cooling fan, and more particularly to a tray-type fan impeller structure.

2. Description of the Related Art

A conventional fan impeller dissipates heat in an active manner. The fan impeller mainly includes a hub and multiple blades arranged along the circumference of the hub at intervals to radially outward extend. A flow way is defined between each two blades. When the fan impeller rotates, the blades drive the fluid to flow. The bending direction of each blade is related to the rotational direction. In case of different rotational direction, it will be impossible to drive the airflow. However, the blades are often non-uniformly arranged or the weights of the blades are uneven. Therefore, when the fan impeller rotates, the blades will cause airflow separation effect. In addition, when the blades periodically blow wind, the blades will create a pulse force to produce wind shear sound. Also, the flowing airflows will interfere with each other. All the above will cause periodical noise problem (blade pass frequency, BPF).

It is therefore tried by the applicant to provide a tray-type fan impeller structure to solve the above problem.

SUMMARY OF THE INVENTION

It is therefore a primary object of the present invention to provide a tray-type fan impeller structure, which can lower the periodical noise problem caused by the conventional blades.

It is a further object of the present invention to provide the above tray-type fan impeller structure, which is free from any blade.

It is still a further object of the present invention to provide the above tray-type fan impeller structure. No matter the fan impeller is clockwise rotated or counterclockwise rotated, the tray-type fan impeller structure can drive the airflow to flow.

To achieve the above and other objects, the tray-type fan impeller structure of the present invention includes a plate body annularly disposed around a hub. The plate body has a connection side connected with the hub and a free side extending in a direction away from the hub. A top face and a bottom face are defined between the connection side and free side. Multiple upper boss bodies are arranged on the top face at intervals. Multiple first gaps are distributed between the upper boss bodies.

Still to achieve the above and other objects, the tray-type fan impeller structure of the present invention includes: a hub having a top wall and a circumferential wall perpendicularly extending from an outer circumference of the top wall, the top wall corresponding to a wind inlet of a frame body; and a plate body having a connection side and a free side radially extending from the connection side, the connection side being connected with the circumferential wall of the hub, a top face and a bottom face being defined between the connection side and the free side, multiple upper boss bodies being arranged on the top face between the connection side and the free side at intervals, a first gap being defined around each upper boss body.

Still to achieve the above and other objects, the tray-type fan impeller structure of the present invention is disposed in a fan frame. The tray-type fan impeller structure includes: a hub having a top wall and a circumferential wall, the top wall corresponding to a wind inlet of a frame body; and a plate body having a wind inlet side and a wind outlet side, the wind inlet side being adjacent to the circumferential wall of the hub, the wind outlet side being positioned in a direction away from the hub, multiple upper boss bodies being disposed on one face of the plate body between the wind inlet side and the wind outlet side, the upper boss bodies being arranged at intervals to form multiple first gaps between the upper boss bodies, an airflow flowing from the wind inlet side through the upper boss bodies and the first gaps to flow out from the wind outlet side.

In the above tray-type fan impeller structure, the upper boss bodies are arranged and distributed at equal intervals and/or unequal intervals.

In the above tray-type fan impeller structure, the upper boss bodies and the plate body are integrally formed.

In the above tray-type fan impeller structure, the upper boss bodies and the plate body are separate unit bodies connected with each other by a connection means.

In the above tray-type fan impeller structure, each upper boss body has a first axial height. The first axial heights of the respective upper boss bodies are equal to or unequal to each other.

In the above tray-type fan impeller structure, the first axial heights of the upper boss bodies are gradually increased or decreased from the connection side to the free side.

In the above tray-type fan impeller structure, the first axial heights of the upper boss bodies are gradually increased and then decreased from the connection side to the free side or gradually decreased and then increased from the connection side to the free side.

In the above tray-type fan impeller structure, the plate body is one single annular plate body.

In the above tray-type fan impeller structure, the plate body includes multiple subsidiary plate body sections, which are assembled to together form an annular plate body.

In the above tray-type fan impeller structure, each upper boss body has a cross-sectional form. The cross-sectional forms of the upper boss bodies are identical or different.

In the above tray-type fan impeller structure, the cross-sectional form of the upper boss body is a geometrical shape selected from a group consisting of circular shape, quadrilateral shape, triangular shape, elliptic shape, pentagonal shape, hexagonal shape, arched shape, windmill shape and pentagram shape.

In the above tray-type fan impeller structure, the upper boss bodies are arranged and distributed in identical pattern or different patterns.

In the above tray-type fan impeller structure, the upper boss bodies are arranged and distributed from the connection side to the free side in a radial form or as multiple concentric circles.

In the above tray-type fan impeller structure, the upper boss bodies are arranged and distributed from the connection side to the free side in multiple geometrical forms.

In the above tray-type fan impeller structure, each upper boss body has a first outer diameter. The first outer diameters of the respective upper boss bodies are equal to or unequal to each other.

In the above tray-type fan impeller structure, the first outer diameters of the upper boss bodies are gradually increased or decreased from the connection side to the free side.

In the above tray-type fan impeller structure, multiple lower boss bodies are arranged under the bottom face of the plate body at intervals. Multiple second gaps are distributed between the lower boss bodies. The bottom face is a plane face or an inclined face.

In the above tray-type fan impeller structure, the upper boss bodies and the lower boss bodies are arranged in identical pattern or different patterns.

In the above tray-type fan impeller structure, the connection side forms a wind inlet side and the free side forms a wind outlet side. The connection members are ribs or blades. The top face of the plate body is a plane face or an inclined face.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
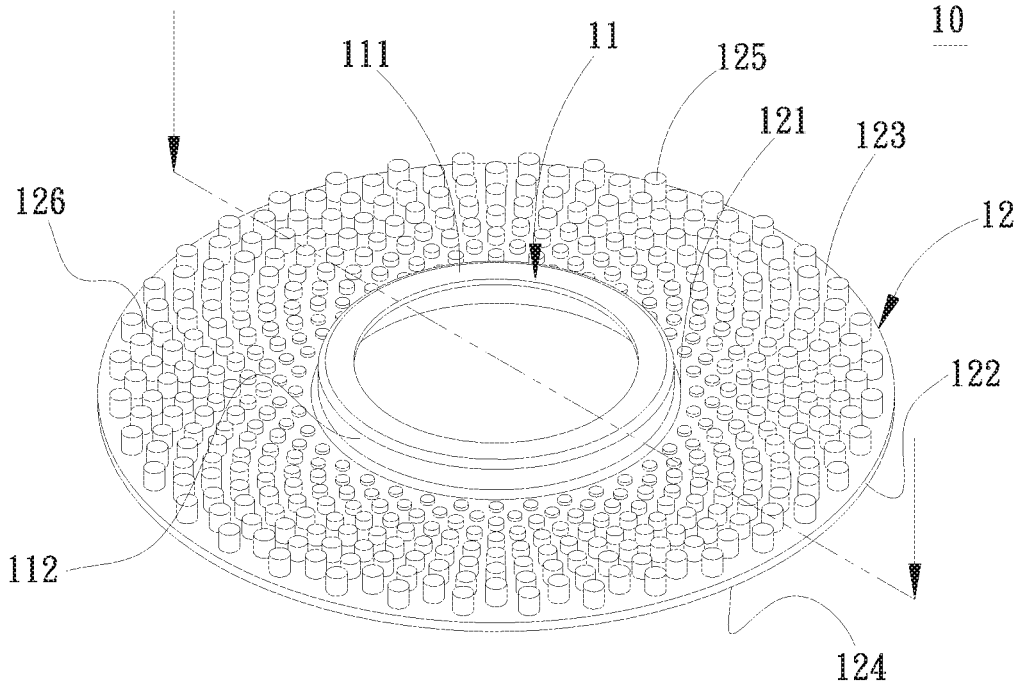
FIG. 1A is a perspective view of the present invention.
Figure 1B:
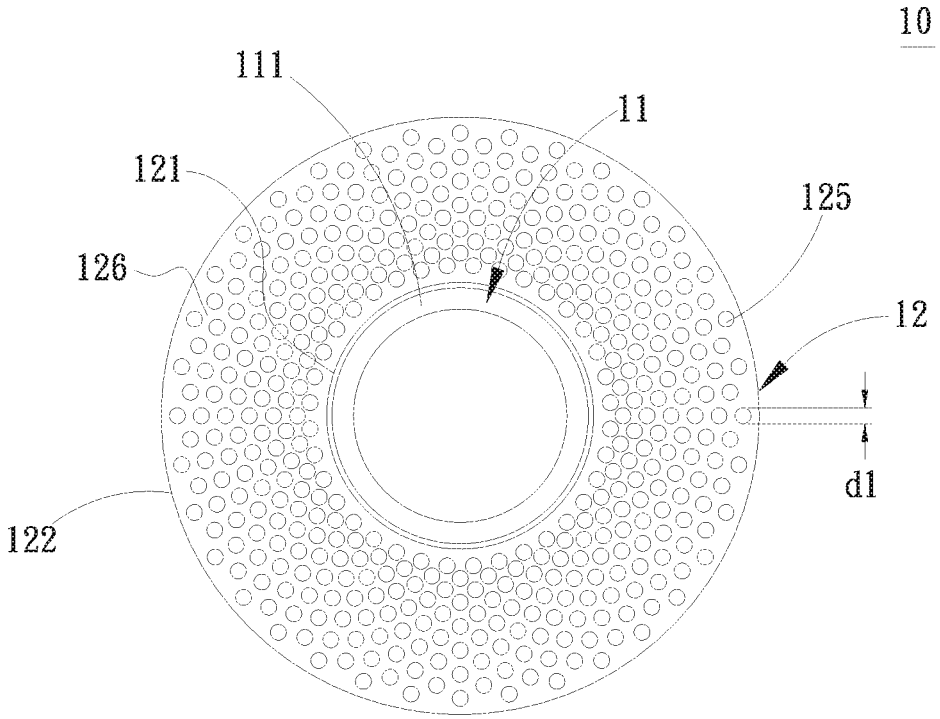
FIG. 1B is a top view of the present invention.

Please refer to FIGS. 1A and 1B. FIG. 1A is a perspective view of the present invention. FIG. 1B is a top view of the present invention. As shown in the drawings, the tray-type fan impeller 10 of the present invention includes a hub 11 and a plate body 12. The hub 11 has a top wall 111 and a circumferential wall 112 perpendicularly extending from an outer circumference of the top wall 111. In this embodiment, the top wall 111 is, but not limited to, formed with a perforation. Alternatively, the top wall 111 can be a structure without any perforation. The plate body 12 is such as an annular plate body annularly disposed around the hub 11. The plate body 12 has a connection side 121 and a free side 122. The connection side 121 is connected with the circumferential wall 112 of the hub 11 to form a wind inlet side. The free side 122 radially extends in a direction away from the hub 11 to form a wind outlet side. A top face 123 and a bottom face 124 are defined between the connection side 121 and the free side 122 respectively on upper face and lower face of the plate body 12. Multiple upper boss bodies (pins) 125 are arranged on the top face 123 at intervals. Multiple first gaps 126 are distributed between the upper boss bodies 125 and/or around the upper boss bodies 125.

Figure 2A:
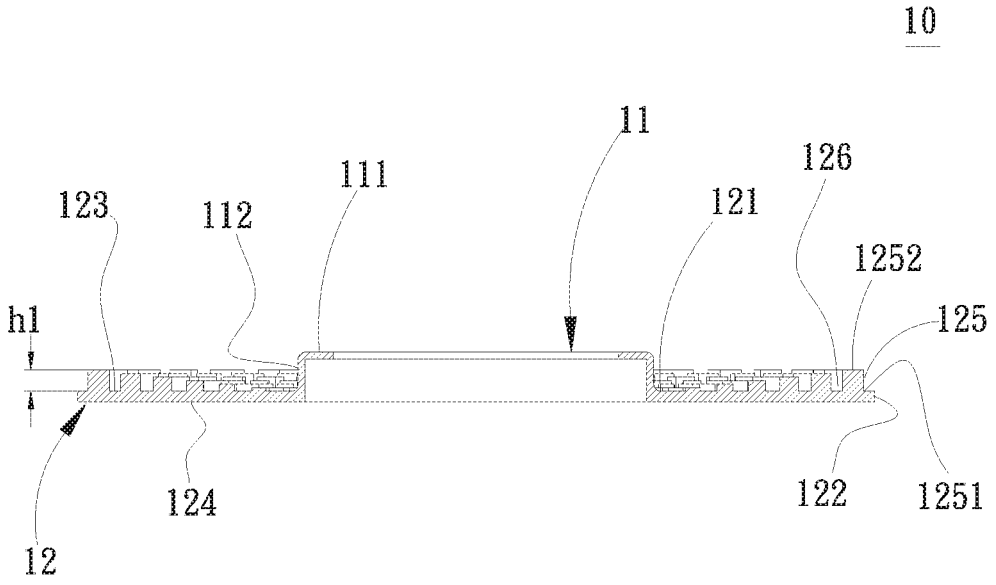
FIGS. 2A to 2F are sectional views of the present invention, showing that the first axial heights of the upper boss bodies are equal to or unequal to each other.
Figure 2B:
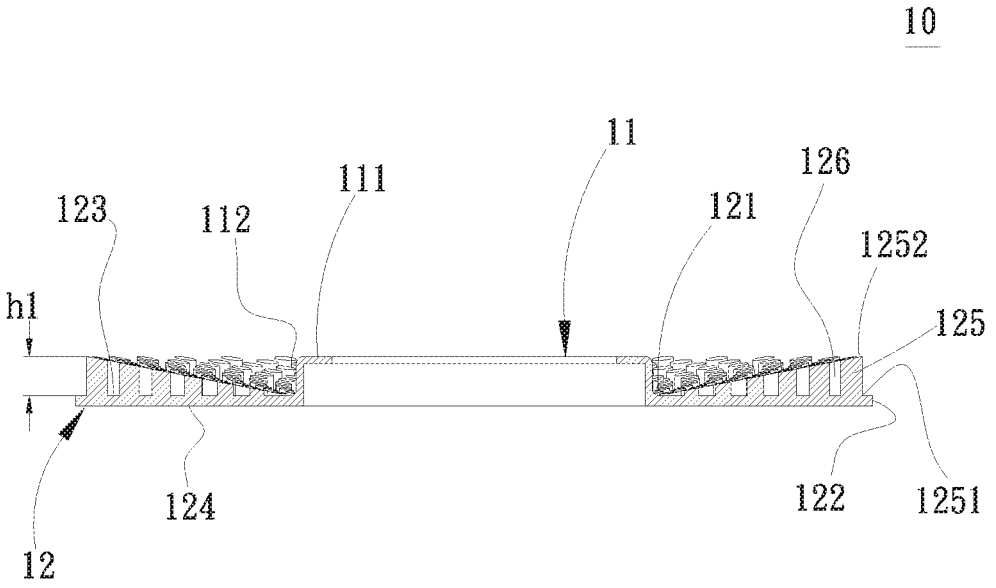
Figure 2C:
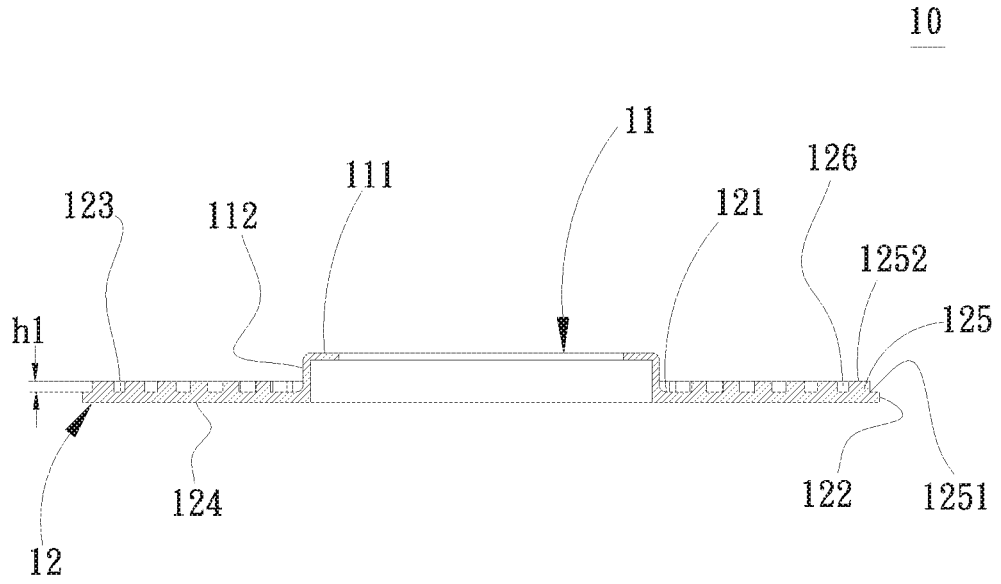
Figure 2D:
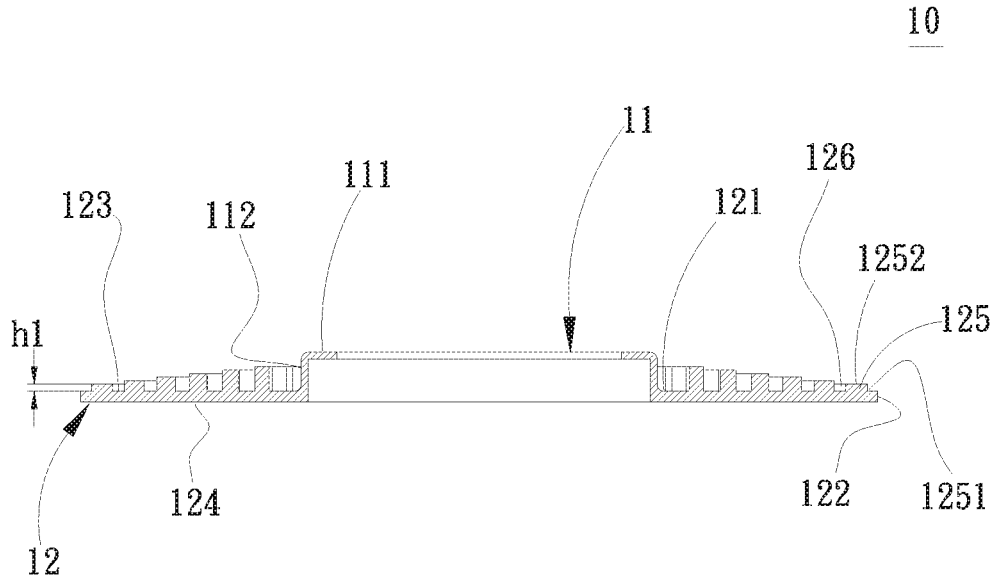
Figure 2E:
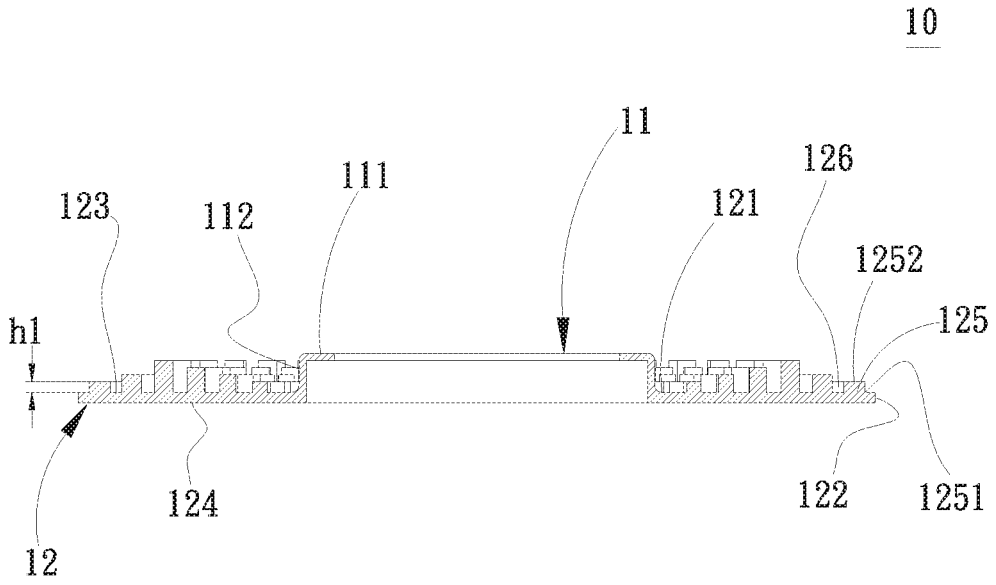
Figure 2F:
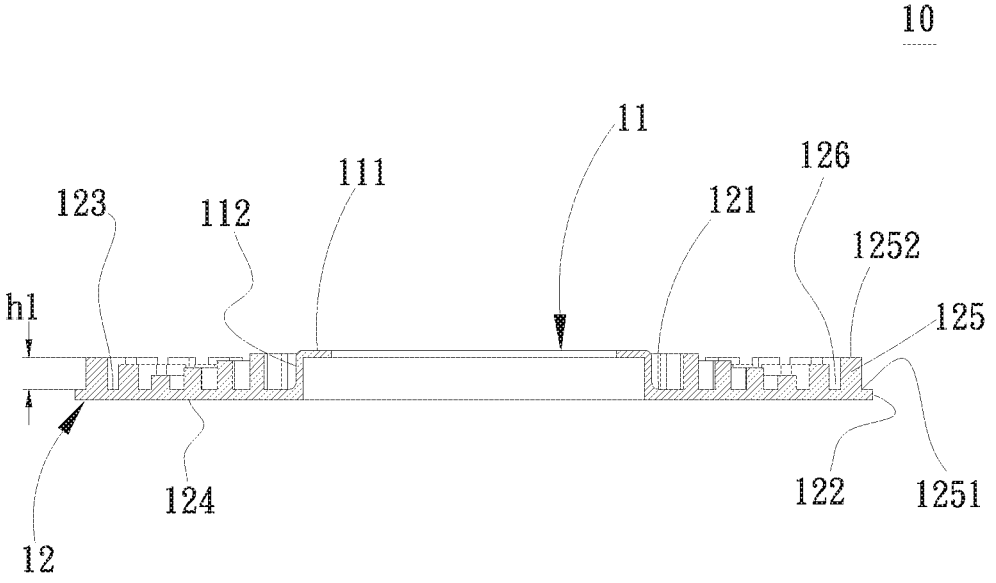

Please further refer to FIGS. 2A to 2F, which are sectional views of the present invention, showing that the first axial heights of the upper boss bodies are equal to or unequal to each other. As shown in the drawings, each upper boss body 125 has a first bottom end 1251 and a first free end 1252. The first bottom end 1251 is connected with the top face 123 of the plate body 12. The first free end 1252 upward extends. A first axial height h1 is defined between the first bottom end 1251 and the first free end 1252. The first axial height h1 can be varied to have different aspects according to the use requirement or in adaptation to the form of the fan frame. For example, in a preferred embodiment as shown in FIGS. 2A and 2B, the first axial heights h1 of the upper boss bodies 125 are gradually increased from the connection side 121 to the free side 122 and the first free ends 1252 of the upper boss bodies 125 are horizontal (as shown in FIG. 2A) or inclined (as shown in FIG. 2B). In FIG. 2B, the first free ends 1252 are, but not limited to, inclined toward the hub 11. Alternatively, the first free ends 1252 can be inclined in a direction away from the hub 11. In this embodiment, the first axial height h1 of the upper boss body 125 near the connection side 121 is lower than the first axial height h1 of the upper boss body 125 near the free side 122. In another embodiment, the first axial heights h1 of all the upper boss bodies 125 are identical to each other (as shown in FIG. 2C). In a modified embodiment, the first axial heights h1 of the upper boss bodies 125 are gradually decreased from the connection side 121 to the free side 122. That is, the first axial height h1 of the upper boss body 125 near the connection side 121 is higher than the first axial height h1 of the upper boss body 125 near the free side 122 (as shown in FIG. 2D). Alternatively, the first axial heights h1 of the upper boss bodies 125 are gradually increased and then gradually decreased. That is, the first axial heights h1 of the upper boss bodies 125 near the connection side 121 and the free side 122 are higher than the first axial height h1 of the upper boss body 125 in the middle (as shown in FIG. 2E). Alternatively, the first axial heights h1 of the upper boss bodies 125 are gradually decreased and then gradually increased. That is, the first axial heights h1 of the upper boss bodies 125 near the connection side 121 and the free side 122 are lower than the first axial height h1 of the upper boss body 125 in the middle (as shown in FIG. 2F).

Figure 2G:
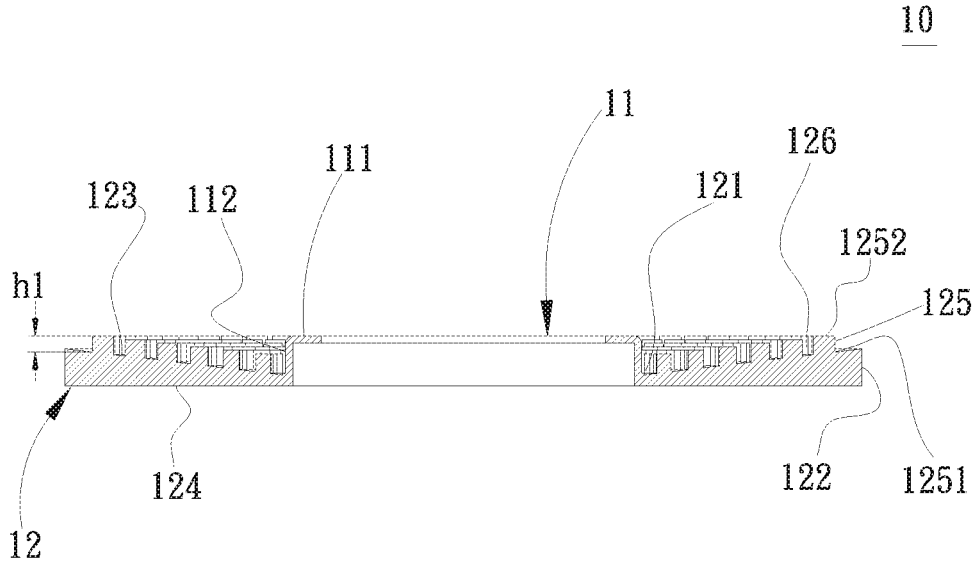
FIGS. 2G and 2H are sectional views of the present invention, showing other different aspects of the top face of the plate body.
Figure 2H:
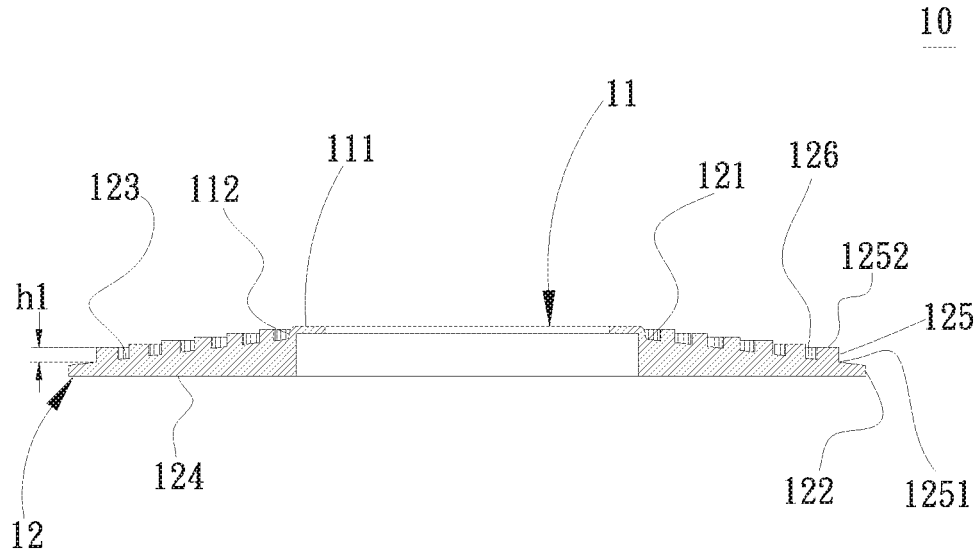
Figure 3A:
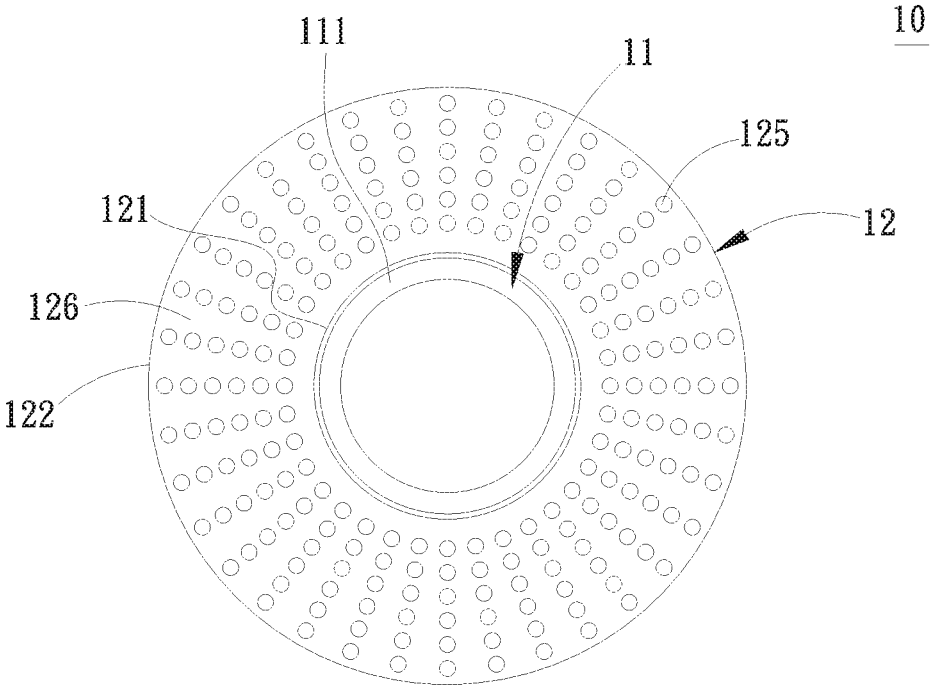
FIGS. 3A to 3F are top views of the present invention, showing that the upper boss bodies are arranged and distributed in the same pattern or different patterns.
Figure 3B:
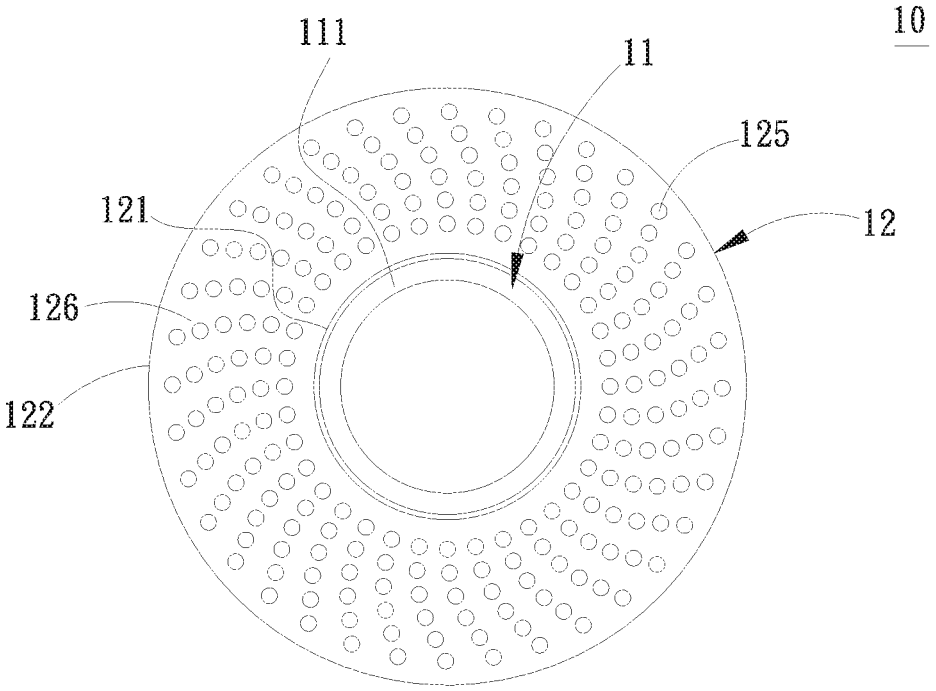
Figure 3C:
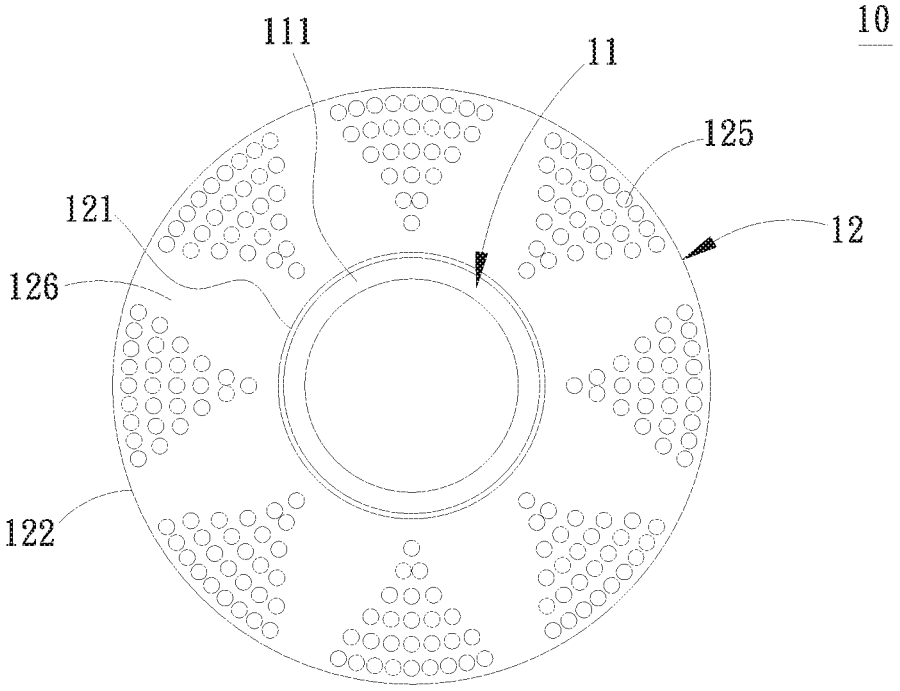
Figure 3D:
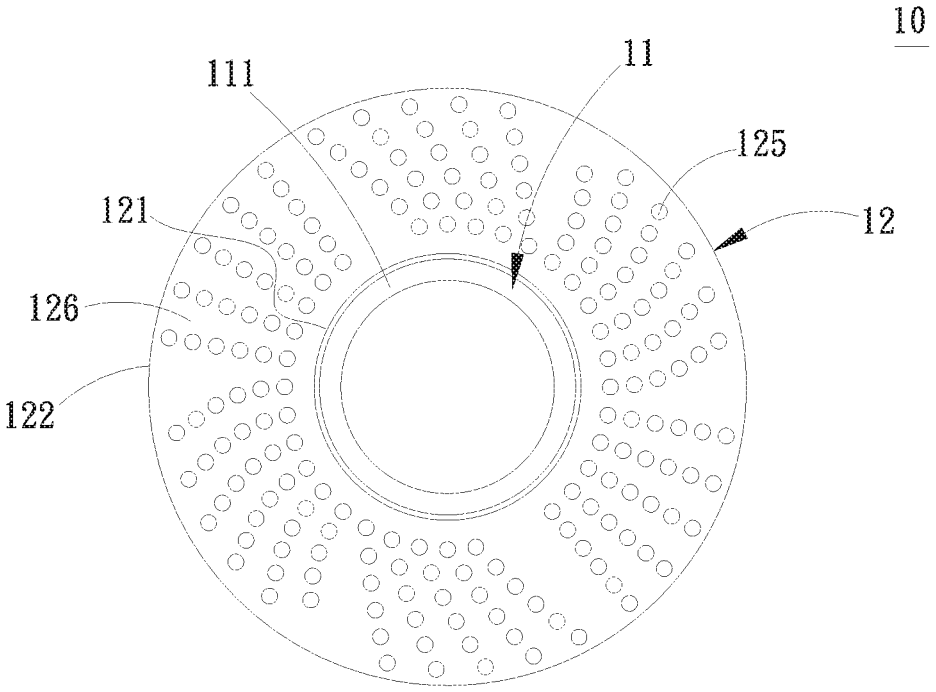
Figure 3E:
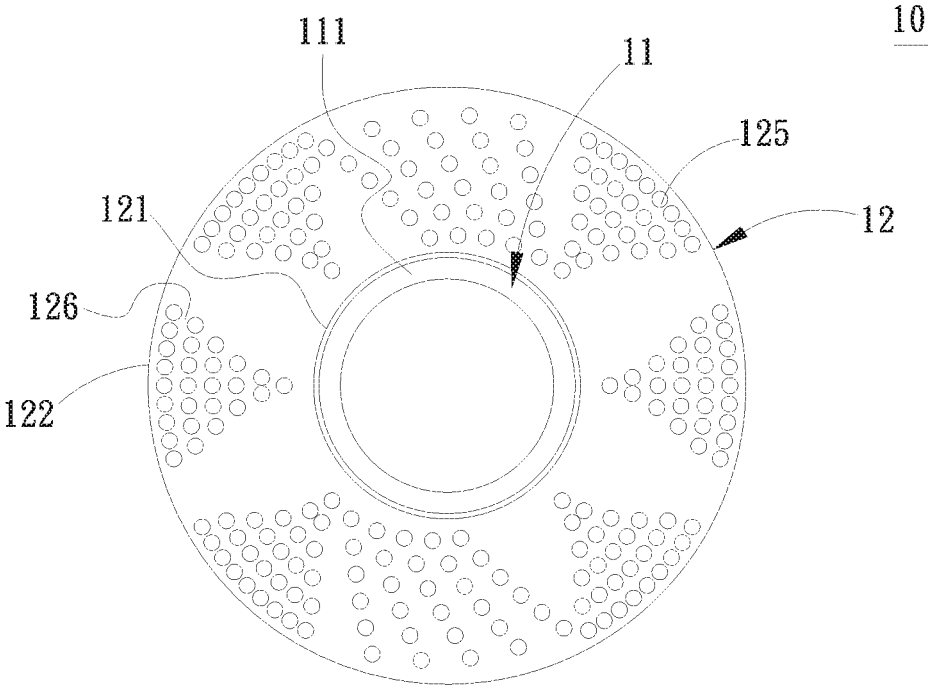
Figure 3F:
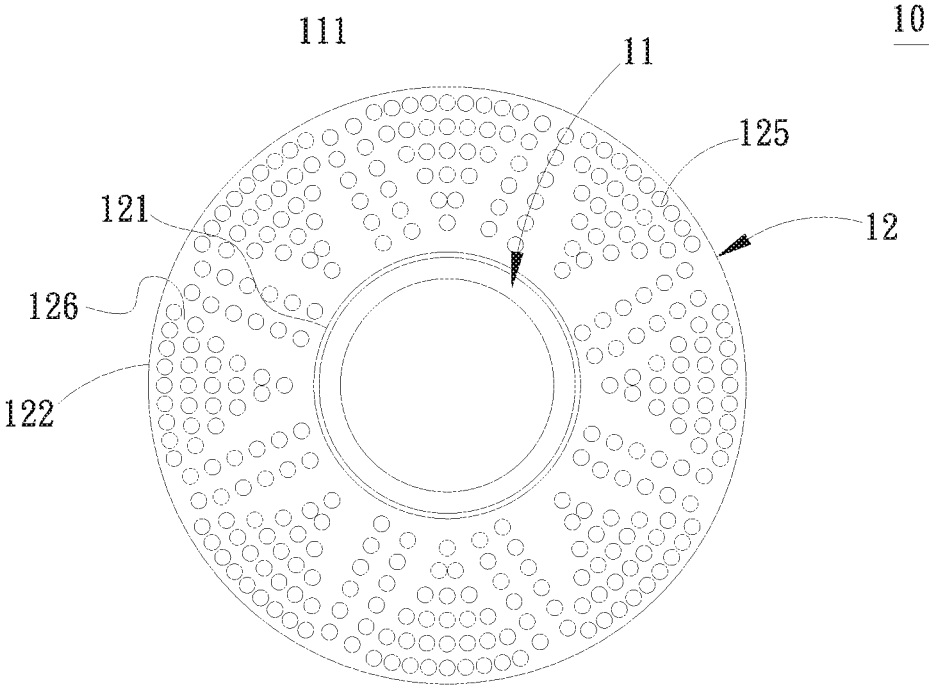

Moreover, please further refer to FIGS. 2G and 2H. In the above embodiments, the top face 123 of the plate body 12 is, but not limited to, a plane face. In some modified embodiments, the top face 123 of the plate body 12 can be an inclined face. For example, the top face 123 of the plate body 12 is inclined toward the hub (as shown in FIG. 2G) or inclined in a direction away from the hub (as shown in FIG. 2H). In this embodiment, the upper boss bodies 125 are gradually raised from the connection side 121 to the free side 122 (as shown in FIG. 2G) or gradually lowered from the connection side 121 to the free side 122 (as shown in FIG. 2F). It should be noted that in the drawings, the upper boss bodies 125 have the same first axial height h1. However, this is not limited. This arrangement is also applicable to those embodiments in which the upper boss bodies 125 have different first axial heights h1. Please further refer to FIGS. 3A to 3F, which are top views of the present invention, showing that the upper boss bodies are arranged and distributed in the same pattern or different patterns. Also referring to FIG. 1B, the upper boss bodies 125 are, but not limited to, arranged and distributed from the connection side 121 to the free side 122 as multiple concentric circles. In some other embodiments, the upper boss bodies 125 are arranged and distributed from the connection side 121 to the free side 122 in a radial form (as shown in FIGS. 3A and 3B). In FIG. 3A, the upper boss bodies 125 are arranged and distributed in a straight radial form. In FIG. 3B, the upper boss bodies 125 are arranged and distributed in a bent radial form. Alternatively, the upper boss bodies 125 can be arranged and distributed in different geometrical forms. For example but not limited, the upper boss bodies 125 can be arranged and distributed in multiple triangular forms (as shown in FIG. 3C). In some other embodiments as shown in FIGS. 3D and 3E, the top face of the plate body is divided into several sections. The upper boss bodies 125 of the respective sections are arranged and distributed in different patterns or manners. For example, the upper boss bodies 125 in some sections are arranged and distributed in a straight radial form, while the upper boss bodies 125 on the rest sections are arranged and distributed in a bent radial form (as shown in FIG. 3D). Alternatively, the upper boss bodies 125 in some sections are arranged in a triangular form, while the upper boss bodies 125 on the rest sections are arranged in a bent radial form (as shown in FIG. 3E). Still alternatively, the upper boss bodies 125 in some sections are arranged in a triangular form, while the upper boss bodies 125 on the rest sections are arranged in a straight radial form (as shown in FIG. 3F). Moreover, in the above embodiments, the upper boss bodies 125 can be arranged at equal intervals (as shown in FIGS. 1B, 3A and 3B) and/or at unequal intervals (as shown in FIGS. 3C, 3E and 3F). Therefore, the density of the first gaps 126 can be adjusted and set according to the requirement. For example, the larger the intervals between the upper boss bodies 125 are, the smaller the density of the first gaps 126 is and the smaller the intervals between the upper boss bodies 125 are, the larger the density of the first gaps 126 is.

Figure 4A:
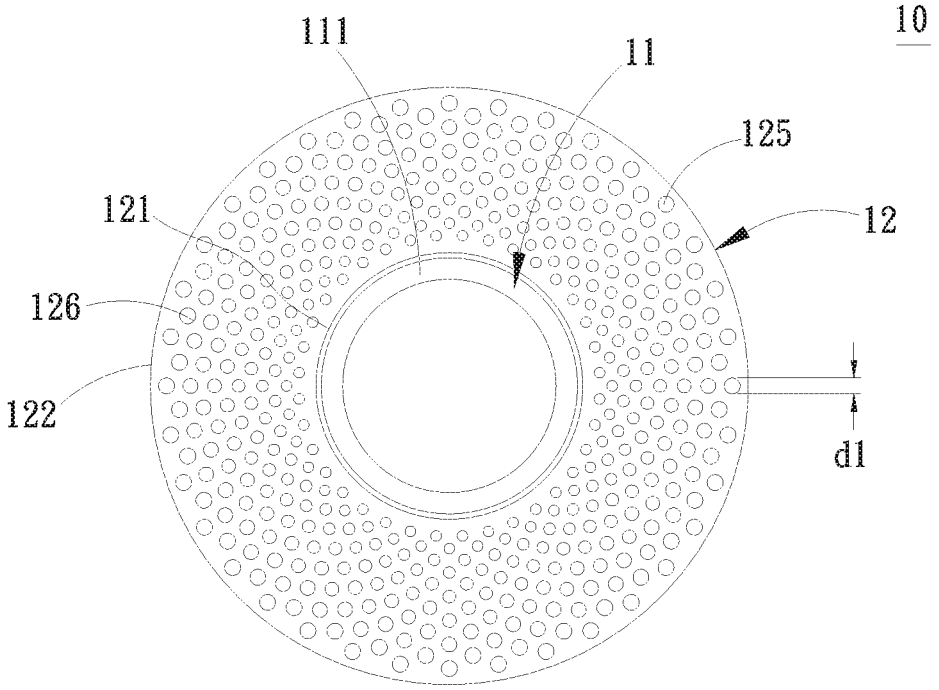
FIGS. 4A and 4B are top views of the present invention, showing that the upper boss bodies have different first outer diameters.
Figure 4B:
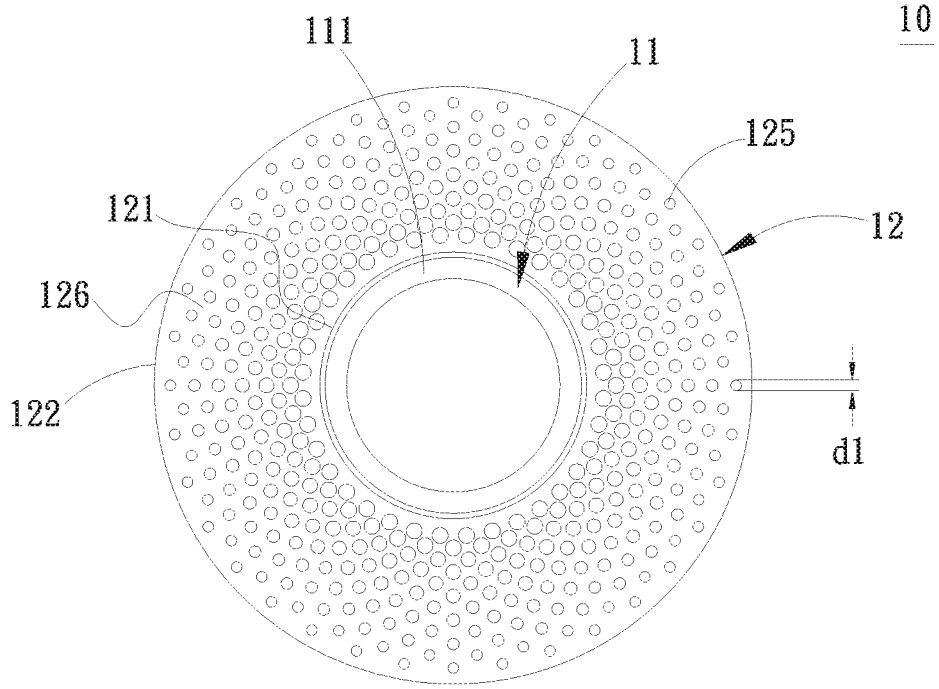

Please further refer to FIGS. 4A and 4B, which are top views of the present invention, showing that the upper boss bodies have different first outer diameters. Also refer to FIG. 1B, each upper boss body 125 has a first outer diameter d1. The first outer diameter d1 is defined as the straight distance between two opposite outermost tangential points. In this drawing, the first outer diameters d1 of the upper boss bodies 125 are, but not limited to, equal to each other. In a modified embodiment as shown in FIG. 4A, the first outer diameters d1 of the upper boss bodies 125 are gradually increased from the connection side 121 of the plate body 12 to the free side 122. That is, the first outer diameter d1 of the upper boss body 125 near the free side 122 is larger than the first outer diameter d1 of the upper boss body 125 near the connection side 121. Alternatively, as shown in FIG. 4B, the first outer diameters d1 of the upper boss bodies 125 are gradually decreased from the connection side 121 of the plate body 12 to the free side 122. That is, the first outer diameter d1 of the upper boss body 125 near the connection side 121 is larger than the first outer diameter d1 of the upper boss body 125 near the free side 122.

Figure 5A:
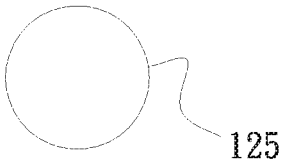
FIGS. 5A to 5I are top views showing the cross sections of the upper boss bodies of the present invention.
Figure 5B:
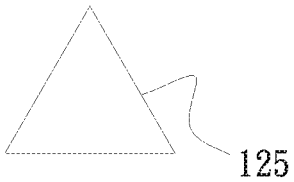
Figure 5C:
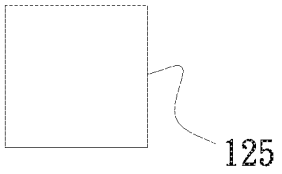
Figure 5D:
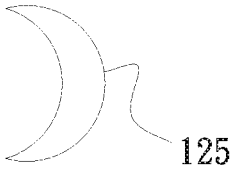
Figure 5E:
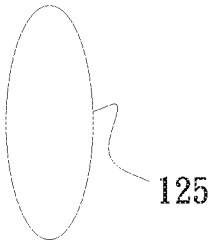
Figure 5F:
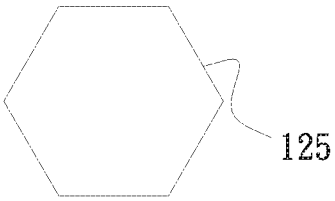
Figure 5G:
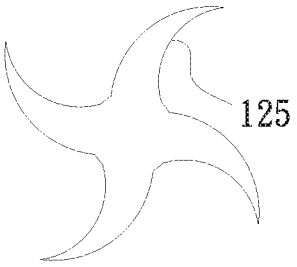
Figure 5H:
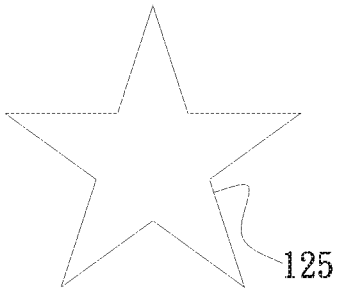
Figure 5I:
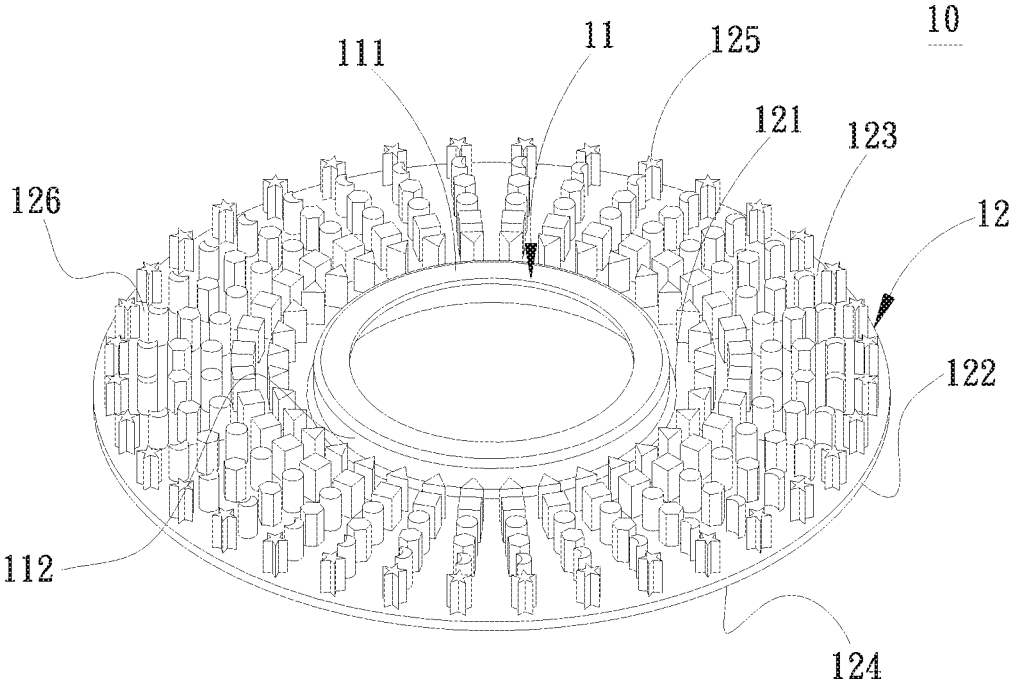

Please further refer to FIGS. 5A to 5I, which are top views showing the cross sections of the upper boss bodies of the present invention. As shown in the drawings, each upper boss body 125 has a cross-sectional form in parallel to the plate body 12 (as shown in FIG. 1A). The cross-sectional form can be any geometrical shape. In the above embodiments, the cross-sectional form is circular shape (as shown in FIG. 5A) so that each upper boss body 125 has, but not limited to, a cylindrical configuration. In some other embodiments, the cross-sectional form can be such as triangular shape (as shown in FIG. 5B), quadrilateral shape (as shown in FIG. 5C), crescent shape (as shown in FIG. 5D, elliptic shape (as shown in FIG. 5E), hexagonal shape (as shown in FIG. 5F), windmill shape (as shown in FIG. 5G) and pentagram shape (as shown in FIG. 5H). In addition, as shown in FIG. 5I, in a modified embodiment, the upper boss bodies 125 on the top face 123 of the plate body 12 have different cross-sectional shapes. For example but not limited, some of the upper boss bodies 125 have circular shape, some have triangular shape, some have quadrilateral shape, some have crescent shape and the rests have pentagram shape.

Figure 6A:
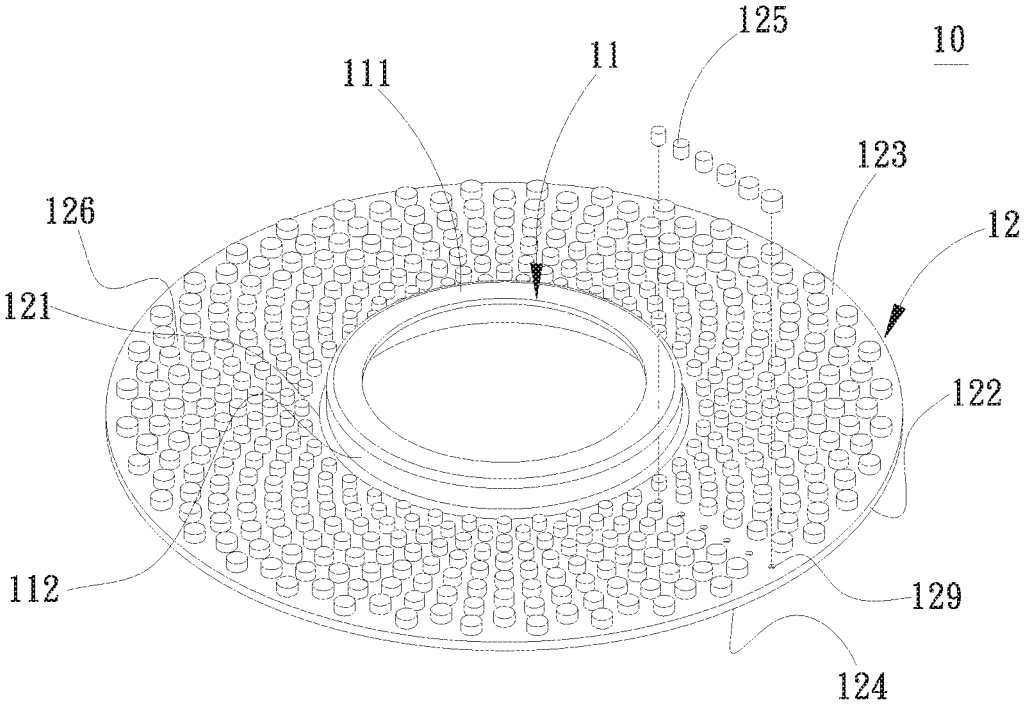
FIGS. 6A and 6B show that the upper boss bodies and the plate body of the present invention are separate unit bodies.
Figure 6B:
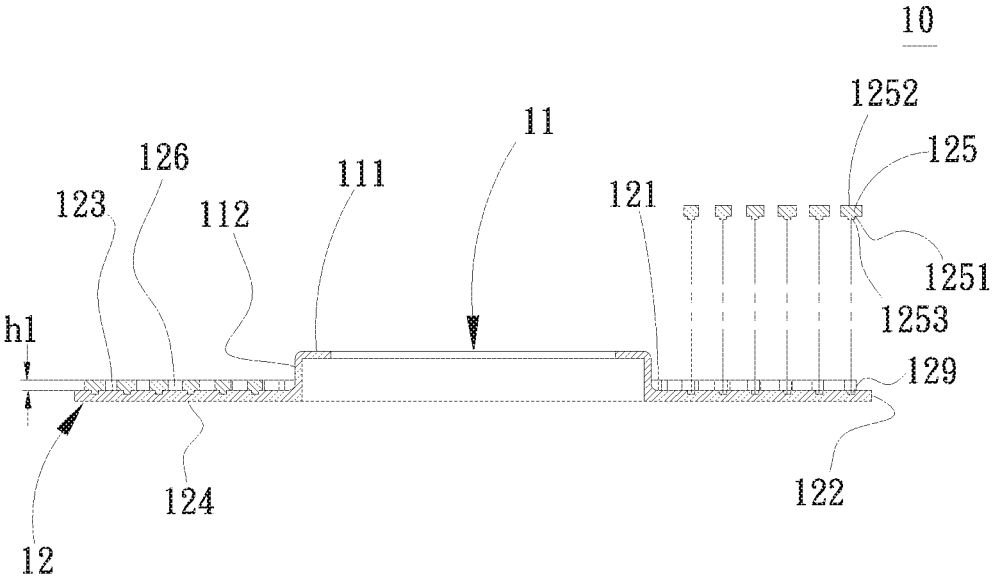

Please further refer to FIGS. 6A and 6B, which show that the upper boss bodies and the plate body of the present invention are separate unit bodies. Also referring to FIGS. 1A and 2A, the upper boss bodies 125 and the plate body 12 are integrally formed by means of such as plastic injection or 3D printing. That is, the upper boss bodies 125 are directly formed on the top face 123 of the plate body 12. However, in some other embodiments as shown in FIGS. 6A and 6B, the upper boss bodies 125 and the plate body 12 are separate unit bodies connected with each other by a connection means. In this drawing, the top face 123 of the plate body 12 is formed with multiple sockets 129 arranged at intervals. Each upper boss body 125 has an insertion section 1253 correspondingly inserted in the socket 127. In some other embodiments, the upper boss bodies 125 are connected on the top face 123 of the plate body 12 by means of such as adhesion or welding.

Figure 7A:
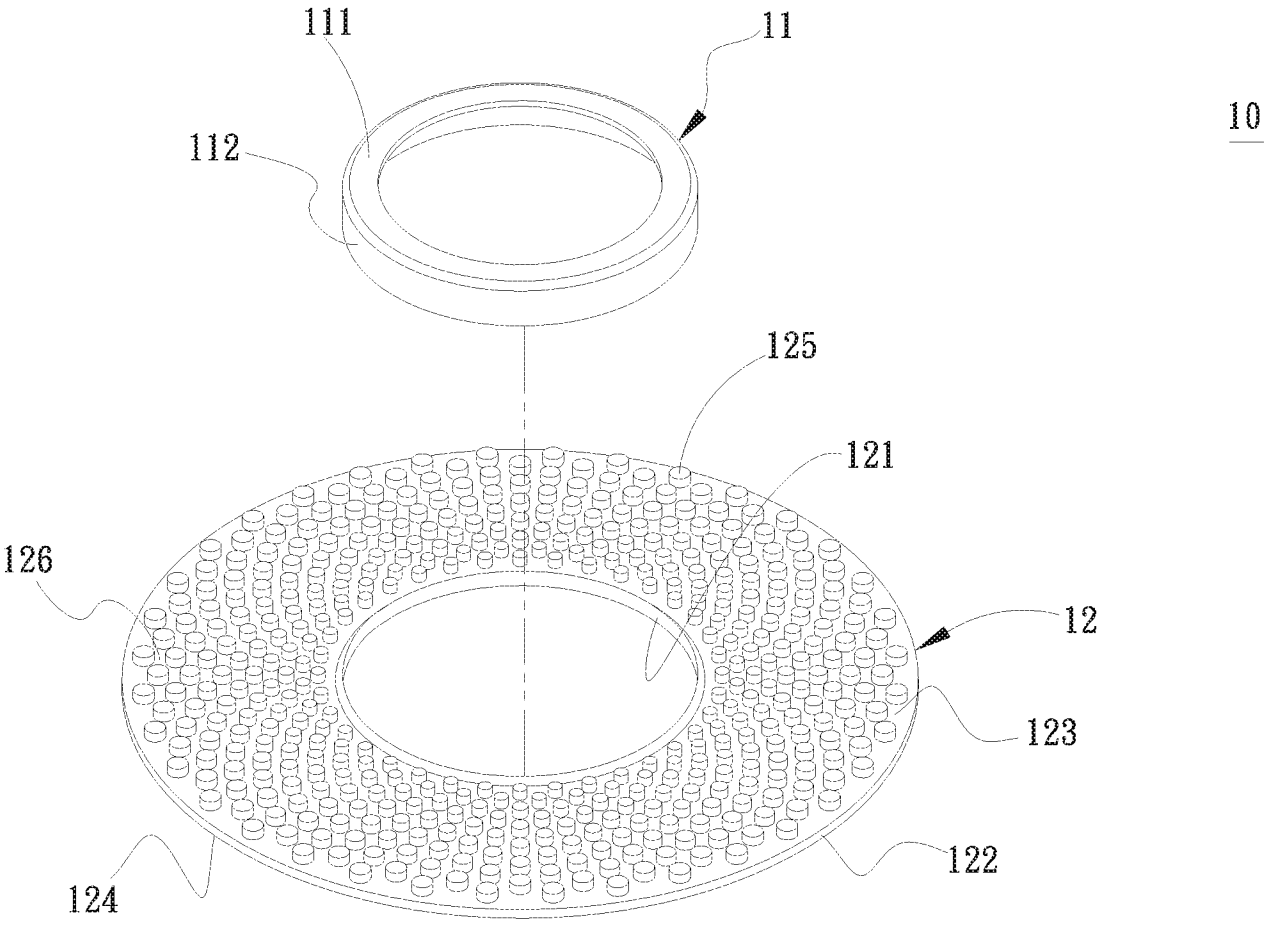
FIG. 7A is a perspective view showing another embodiment of the connection between the plate body and the hub of the present invention.
Figure 7B:
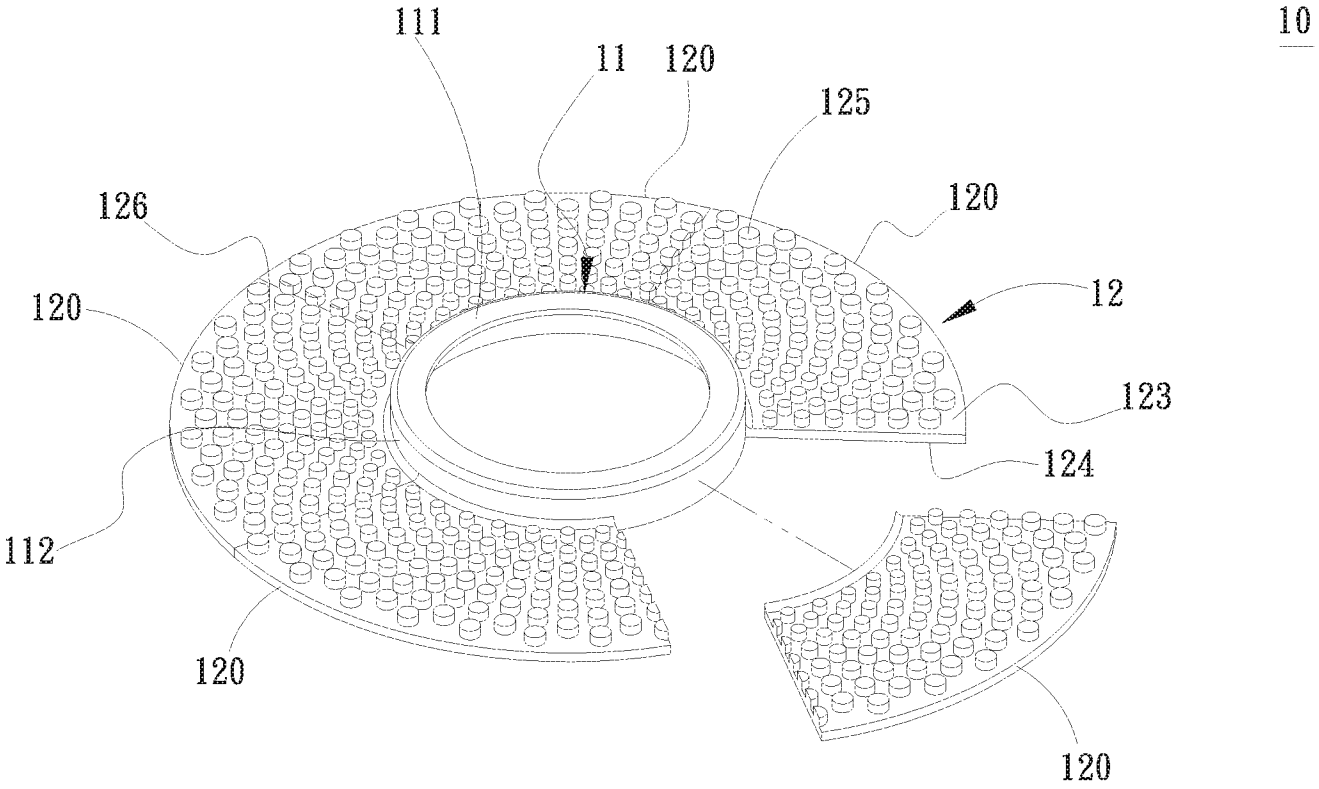
FIG. 7B is a perspective view showing another embodiment of the connection between the plate body and the hub of the present invention.

Please further refer to FIGS. 7A and 7B. FIG. 7A is a perspective view showing another embodiment of the connection between the plate body and the hub of the present invention. FIG. 7B is a perspective view showing another embodiment of the connection between the plate body and the hub of the present invention. Also referring to FIGS. 1A and 1B, the plate body 12 and the hub 11 are, but not limited to, integrally formed. In a modified embodiment as shown in FIG. 7A, the plate body 12 and the hub 11 are not an integrally formed structure, but are separate unit bodies. The plate body 12 and the hub 11 are connected with each other by means of adhesion, welding-material welding, ultrasonic fusion or laser welding. In another embodiment as shown in FIG. 7B, the plate body 12 includes multiple subsidiary plate body sections 120. (In this drawing, there are, but not limited to, seven subsidiary plate body sections 120). The subsidiary plate body sections 120 surround and connect with the circumferential wall 112 of the hub 11 to together form an annular plate body. The arrangements of the upper boss bodies 125 on the respective subsidiary plate body sections 120 can be identical or different. For example, the gaps, the outer diameters, the arrangement patterns, the cross-sectional shapes or the first axial heights of the upper boss bodies 125 can be identical or different.

Figure 7C:
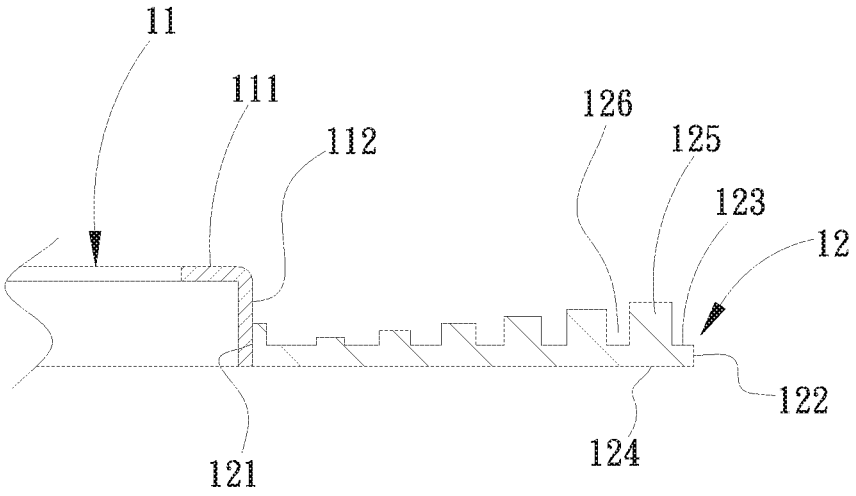
FIGS. 7C and 7D show that the plate body and the hub of the present invention are interference-connected with each other.
Figure 7D:
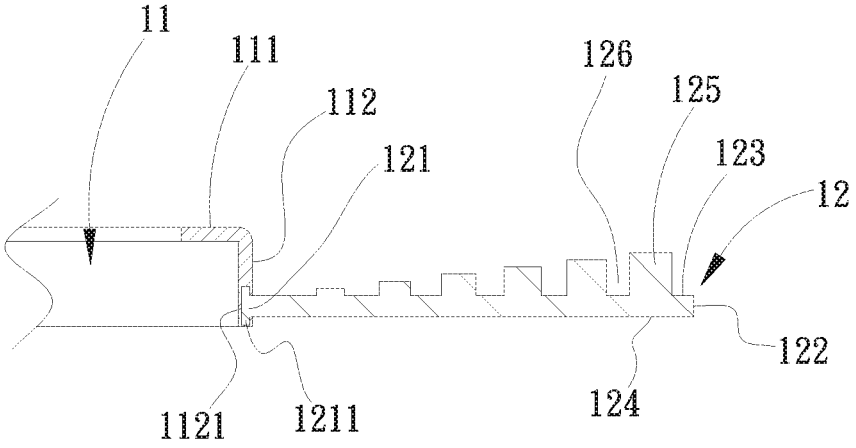

Please further refer to FIGS. 7C and 7D, which show that the connection members and the plate body or the hub of the present invention are interference-connected with each other. As aforesaid, the plate body 12 and the hub 11 are not an integrally formed structure, but are separate unit bodies. The connection side 121 of the plate body 12 is connected with the circumferential wall 112 of the hub 11 by the above connection means (as shown in FIG. 7C). In another embodiment, the connection side 121 of the plate body 12 is first interference-connected with the circumferential wall 112 of the hub 11 and then further connected therewith by the above connection means. The connection side 121 of the plate body 12 is such interference-connected with the circumferential wall 112 of the hub 11 that the circumferential wall 112 of the hub 11 is formed with a cavity 1121 and the connection side 121 of the plate body 12 has an interference section 1211. The interference section 1211 is inserted in the cavity 1121.

Figure 8A:
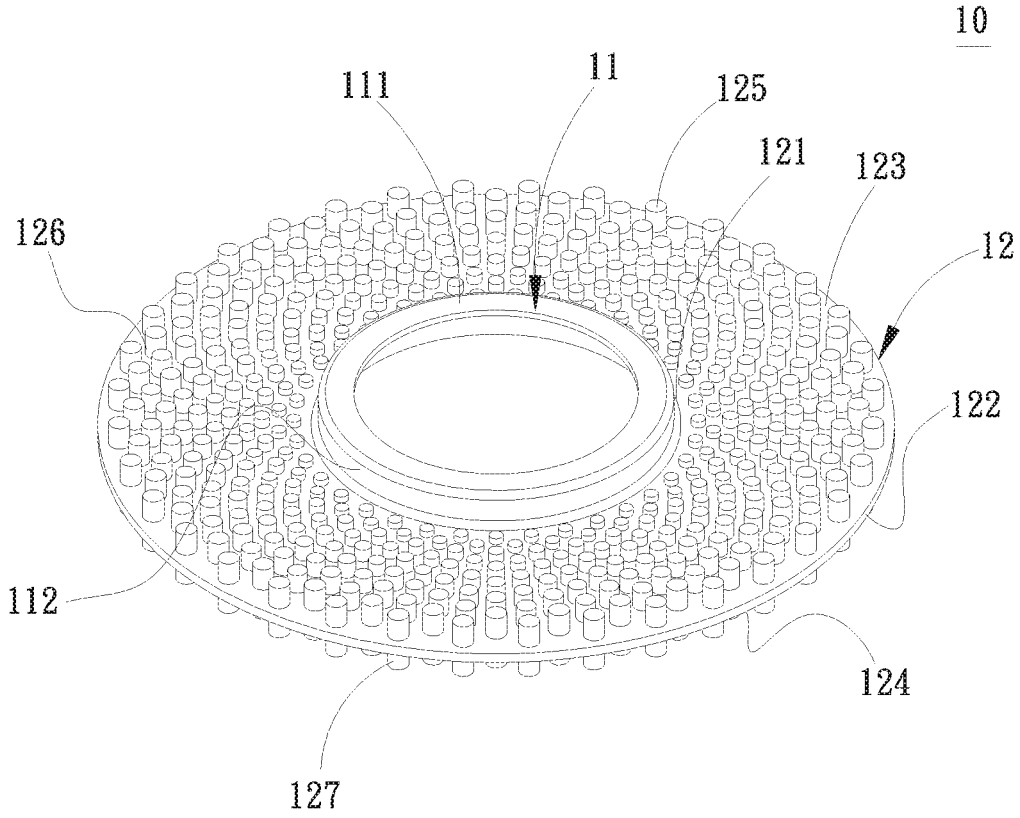
FIGS. 8A to 8C are perspective views showing that multiple lower boss bodies are arranged under the bottom face of the plate body of the present invention.
Figure 8B:
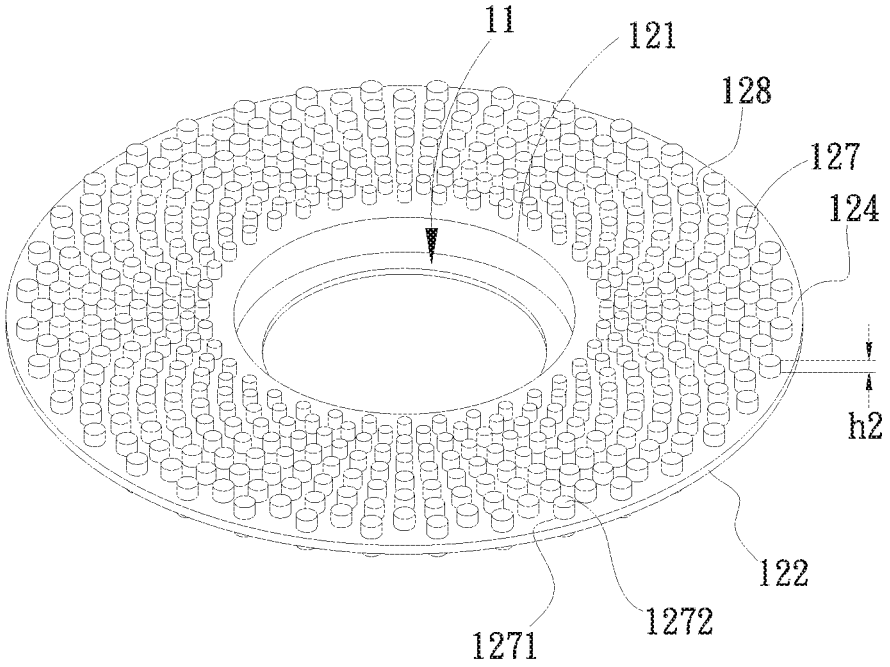
Figure 8C:
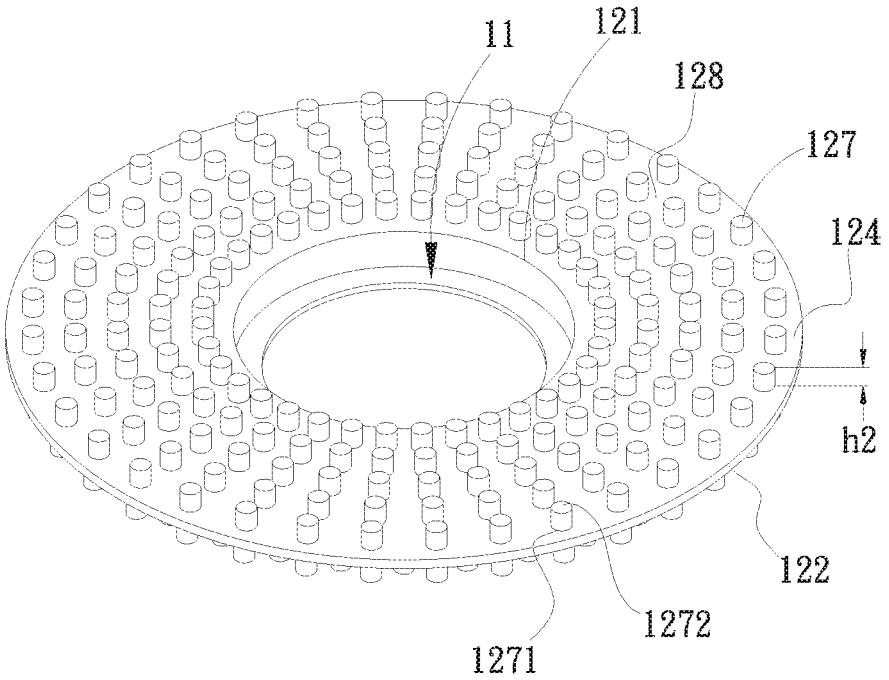

Please further refer to FIGS. 8A, 8B and 8C, which are perspective views showing that multiple lower boss bodies are arranged under the bottom face of the plate body of the present invention. Also referring to FIGS. 1A and 1B, in another embodiment, multiple lower boss bodies 127 are arranged under the bottom face 124 of the plate body 12 at intervals. Multiple second gaps 128 are distributed between the lower boss bodies 127 or around the upper boss bodies 127. Each lower boss body 127 has a second bottom end 1271 and a second free end 1272. The second bottom end 1271 is connected with the bottom face 124. The second free end 1272 downward extends. A second axial height h2 is defined between the second bottom end 1271 and the second free end 1272. The lower boss bodies 127 are identical to the upper boss bodies 125 and thus will not be redundantly described hereinafter. However, it should be noted that the arrangements of the upper boss bodies 125 and the lower boss bodies 127 of the same plate body 12 can be identical. For example, the upper boss bodies 125 and the lower boss bodies 127 are arranged and distributed from the connection side 121 to the free side 122 as multiple concentric circles. The first axial heights h1 and the second axial heights h2 are gradually increased from the connection side 121 to the free side 122 (as shown in FIGS. 8A and 8B). However, in some other embodiments, the arrangements of the upper boss bodies 125 and the lower boss bodies 127 of the same plate body 12 can be different. For example but not limited to, the upper boss bodies 125 are arranged and distributed as multiple concentric circles as shown in FIG. 8A, while the lower boss bodies 127 are arranged and distributed in a radial form.

Figure 8D:
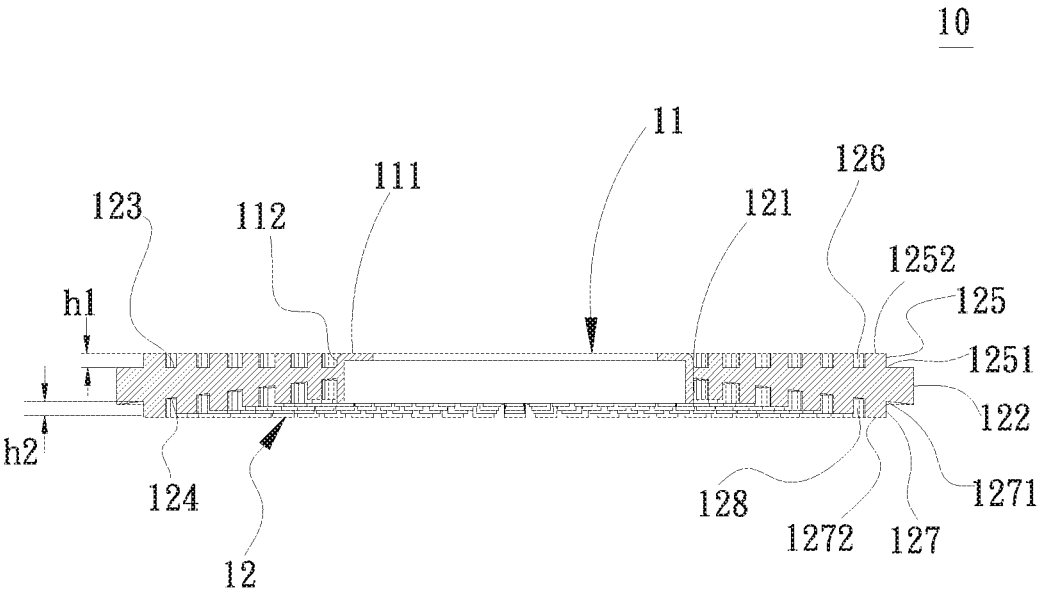
FIGS. 8D and 8E are sectional views showing some other embodiments of the bottom face of the plate body of the present invention.
Figure 8E:
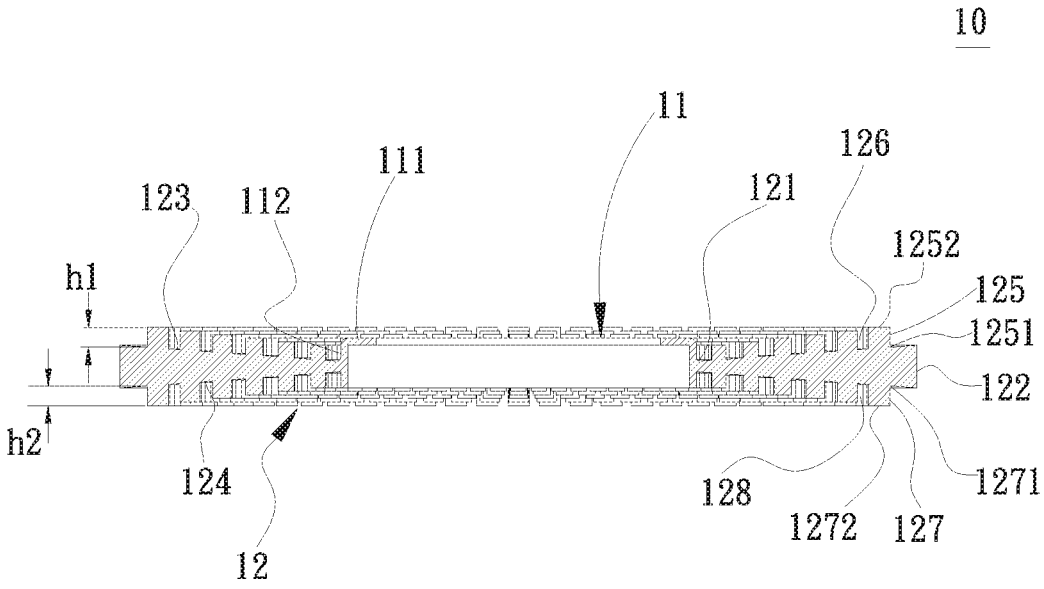

Please further refer to FIGS. 8D and 8E, which are sectional views showing some other embodiments of the bottom face of the plate body of the present invention. In the above embodiments, the bottom face 124 of the plate body 12 is, but not limited to a plane face. In a modified embodiment, the bottom face 124 of the plate body 12 can be an inclined face, whereby the lower boss bodies 127 are gradually raised from the connection side 121 to the free side 122 (as shown in FIG. 8D). In another embodiment, both the top face 123 and the bottom face 124 of the plate body 12 are inclined faces. The top face 123 and the bottom face 124 are gradually raised from the connection side 121 to the free side 122. In the drawings, the upper boss bodies 125 and the lower boss bodies 127 have the same first axial height h1 and the same second axial height h2. However, this is not limited. This arrangement is also applicable to those embodiments in which the upper boss bodies 125 have different first axial heights h1 and/or the lower boss bodies 127 have different second axial heights h2.

Figure 9A:
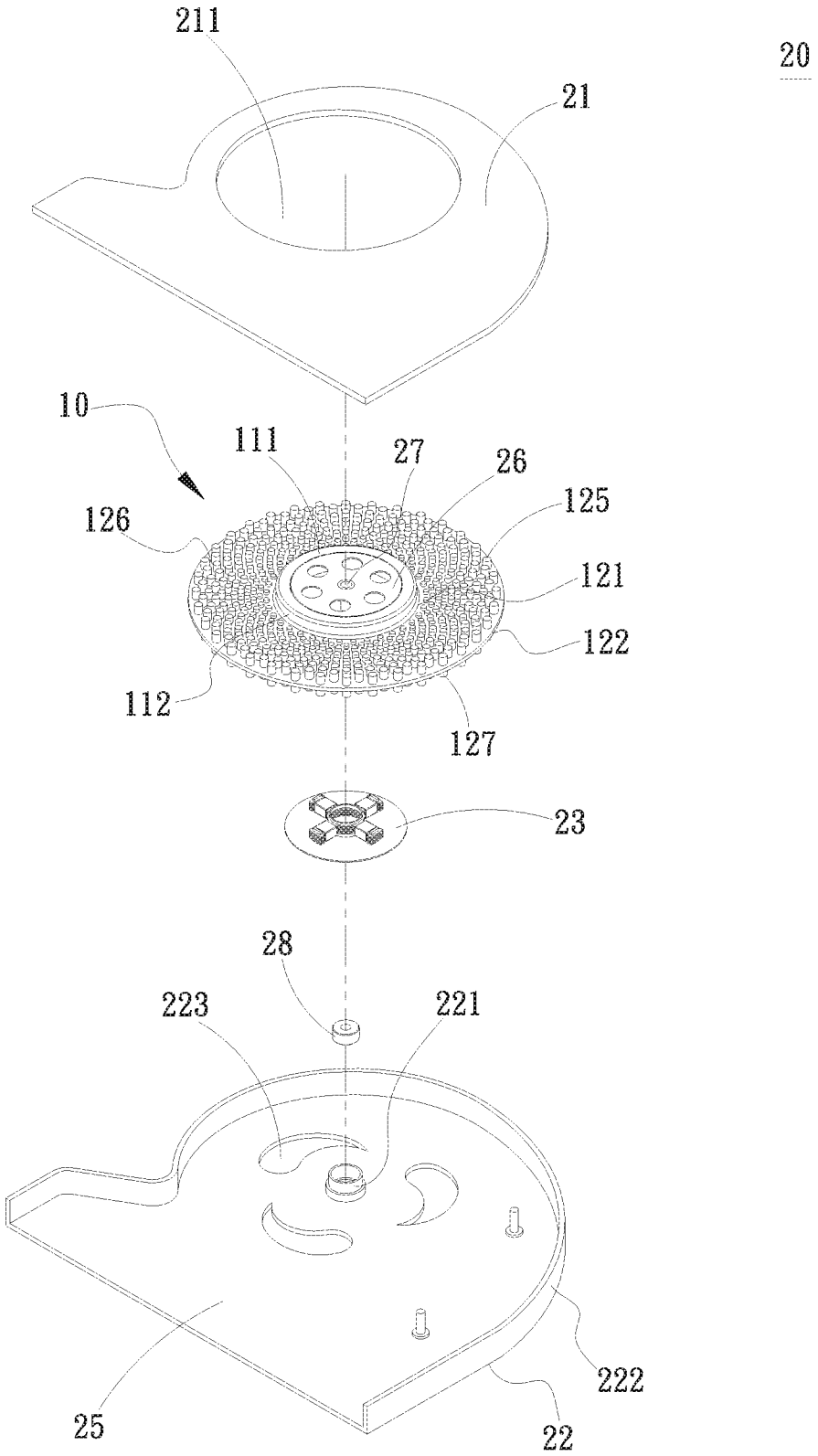
FIGS. 9A and 9B are perspective views showing that the tray-type fan impeller structure is disposed in a fan frame.
Figure 9B:
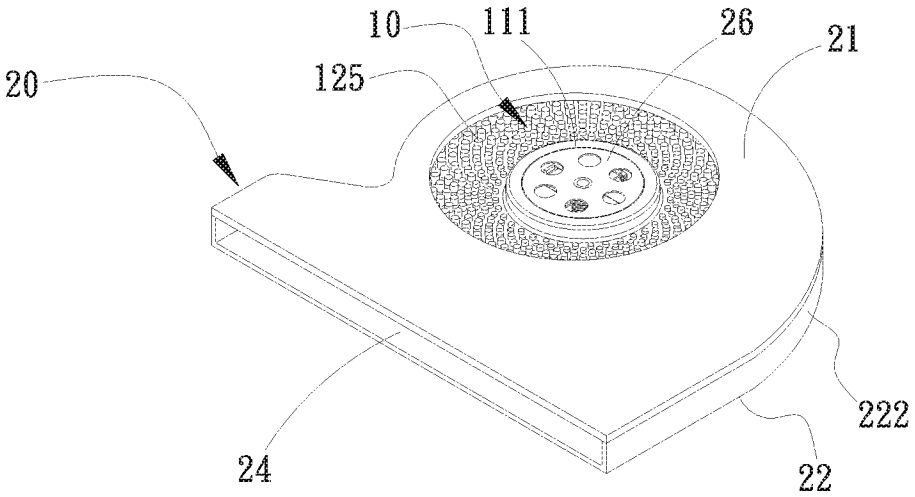

Please now refer to FIGS. 9A and 9B, which are perspective views showing that the tray-type fan impeller structure is disposed in a fan frame. Also referring to FIGS. 8A to 8C, the fan frame 20 has an upper case 21 and a lower case 22. The upper case 21 has a wind inlet 211. The lower case 22 has a connection seat 221 and a peripheral wall 222. The upper and lower cases 21, 22 define therebetween a wind outlet 24 and a flow way 25. A stator assembly 23 is fitted on the connection seat 221. In addition, multiple windows 223 are selectively formed around the connection seat 221. In the drawings, the peripheral wall 222 is disposed along a peripheral of the lower case 22 and perpendicularly extends to connect with the upper case 21. The flow way 25 communicates with the wind outlet 24.

A rotor assembly 26 (including an iron case and a magnet) and a shaft rod 27 are disposed on the inner face of the hub 11 of the tray-type fan impeller 10. The shaft rod 27 is inserted in at least one bearing 28 disposed in the connection seat 221 to support the tray-type fan impeller 10 on the connection seat 221. The rotor assembly 26 corresponds to the stator assembly 23. The top wall 111 of the hub 11 corresponds to the wind inlet 211 of the frame body 20. The diameter of the wind inlet 211 of the frame body 20 is such as but not limited to, larger than the diameter of the top wall 111 of the hub 11. The lower boss bodies 127 correspond to the multiple windows 223. When the tray-type fan impeller 10 rotates, a fluid is driven to flow into the wind inlet 211. The fluid passes through the connection side 121 (or wind inlet side) of the plate body 12. Then the fluid passes through the upper boss bodies 125 and the first gaps 126 to flow out from the free side 122 (or wind outlet side). Then the fluid flows through the flow way 25 to flow out from the wind outlet 24. Also, when the tray-type fan impeller 10 rotates, the airflow is driven to flow into the windows 223 to pass through the connection side 121 (or wind inlet side) of the plate body 12. Then the airflow passes through the lower boss bodies 127 and the second gaps 128 to flow out from the free side 122 (or wind outlet side). Then the airflow flows through the flow way 25 to flow out from the wind outlet 24.

In conclusion, in comparison with the conventional technique, the tray-type fan impeller structure 10 of the present invention lowers the periodical noise problem caused by the conventional blades. In addition, no matter the fan impeller is clockwise rotated or counterclockwise rotated, the tray-type fan impeller structure can drive the airflow to flow.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan structure with tray-type impeller comprising:

a fan frame having an upper case and a lower case, the upper case having a wind inlet, and the lower case having a connection seat;

a tray-type impeller disposed in the fan frame, and having a plate body annularly disposed around a hub, the plate body having a connection side connected with the hub and a free side extending in a direction away from the hub, a top face and a bottom face being defined between the connection side and free side, the top face being an inclined face, multiple upper boss bodies being pins and arranged on the top face at intervals and each upper boss body having a first bottom end to dispose on the inclined face to form an unequal height arrangement, multiple first gaps being distributed between the upper boss bodies, and the hub supported on the connection seat of the fan frame and corresponded to the wind inlet of the frame body, and a fluid driven by the tray-type impeller to flow into the wind inlet, and to pass through the upper boss bodies and the first gaps, and to flow out from the free side.

2. The tray-type fan impeller structure as claimed in claim 1, wherein the upper boss bodies are arranged and distributed at equal intervals and/or unequal intervals.

3. The tray-type fan impeller structure as claimed in claim 1, wherein the upper boss bodies and the plate body are integrally formed.

4. The tray-type fan impeller structure as claimed in claim 1, wherein the upper boss bodies and the plate body are separate unit bodies connected with each other by a connection means.

5. The tray-type fan impeller structure as claimed in claim 1, wherein each upper boss body has a first free end opposite the first bottom end, a first axial height being defined between the first bottom end and the first free end of each upper boss body, the first axial heights of the respective upper boss bodies being equal to or unequal to each other.

6. The tray-type fan impeller structure as claimed in claim 5, wherein the first axial heights of the upper boss bodies are gradually increased or decreased from the connection side to the free side.

7. The tray-type fan impeller structure as claimed in claim 5, wherein the first axial heights of the upper boss bodies are gradually increased and then decreased from the connection side to the free side or gradually decreased and then increased from the connection side to the free side.

8. The tray-type fan impeller structure as claimed in claim 1, wherein the plate body is one single annular plate body and the plate body and the hub being integrally formed or not integrally formed.

9. The tray-type fan impeller structure as claimed in claim 1, wherein the plate body includes multiple subsidiary plate body sections, which are assembled to together form an annular plate body.

10. The tray-type fan impeller structure as claimed in claim 1, wherein each upper boss body has a cross-sectional form in parallel to the plate body, the cross-sectional forms of the upper boss bodies being identical or different.

11. The tray-type fan impeller structure as claimed in claim 10, wherein the cross-sectional form of the upper boss body is a geometrical shape selected from a group consisting of circular shape, quadrilateral shape, triangular shape, elliptic shape, pentagonal shape, hexagonal shape, arched shape, windmill shape and pentagram shape.

12. The tray-type fan impeller structure as claimed in claim 1, wherein the upper boss bodies are arranged and distributed in identical pattern or different patterns.

13. The tray-type fan impeller structure as claimed in claim 12, wherein the upper boss bodies are arranged and distributed from the connection side to the free side in a radial form or as multiple concentric circles.

14. The tray-type fan impeller structure as claimed in claim 12, wherein the upper boss bodies are arranged and distributed from the connection side to the free side in multiple geometrical forms.

15. The tray-type fan impeller structure as claimed in claim 1, wherein each upper boss body has a first outer diameter, the first outer diameters of the respective upper boss bodies being equal to or unequal to each other.

16. The tray-type fan impeller structure as claimed in claim 15, wherein the first outer diameters of the upper boss bodies are gradually increased or decreased from the connection side to the free side.

17. The tray-type fan impeller structure as claimed in claim 1, wherein multiple lower boss bodies are arranged under the bottom face of the plate body at intervals, multiple second gaps being distributed between the lower boss bodies, the bottom face being a plane face or an inclined face.

18. The tray-type fan impeller structure as claimed in claim 17, wherein the upper boss bodies and the lower boss bodies are arranged in identical pattern or different patterns.

19. The tray-type fan impeller structure as claimed in claim 1, wherein the connection side forms a wind inlet side and the free side forms a wind outlet side.

20. A fan structure with tray-type impeller comprising:

a fan frame having an upper case and a lower case, the upper case having a wind inlet, and the lower case having a connection seat;

a hub supported on the connection seat of the fan frame, and having a top wall and a circumferential wall perpendicularly extending from an outer circumference of the top wall, the top wall corresponding to a wind inlet of a fan frame; and a plate body disposed around the hub and having a connection side and a free side radially extending from the connection side, the connection side being connected with the circumferential wall of the hub, a top face and a bottom face being defined between the connection side and the free side, the top face being an inclined face, multiple upper boss bodies being pins and arranged on the top face between the connection side and the free side at intervals and each upper boss body having a first bottom end to dispose on the inclined face to form an unequal height arrangement, a first gap being defined around each upper boss body, and a fluid driven by the plate body to flow into the wind inlet, and to pass through the upper boss bodies and the first gaps, and to flow out from the free side.

21. The tray-type fan impeller structure as claimed in claim 20, wherein multiple lower boss bodies are arranged under the bottom face at intervals, a second gap being defined around each lower boss body.

22. The tray-type fan impeller structure as claimed in claim 21, wherein the upper boss bodies and the lower boss bodies are arranged in identical pattern or different patterns.

23. The tray-type fan impeller structure as claimed in claim 20, wherein the connection side forms a wind inlet side and the free side forms a wind outlet side.

24. A tray-type impeller disposed in a fan frame, the tray-type fan impeller structure comprising:

a hub supported on a connection seat of the fan frame, and having a top wall and a circumferential wall, the top wall corresponding to a wind inlet of the fan frame; and a plate body disposed around the hub and having a wind inlet side and a wind outlet side, the wind inlet side being adjacent to the circumferential wall of the hub, the wind outlet side being positioned in a direction away from the hub, multiple upper boss bodies being pins and disposed on an inclined top face of the plate body between the wind inlet side and the wind outlet side, each upper boss body having a first bottom end to dispose on the inclined top face to form unequal height arrangement, the upper boss bodies being arranged at intervals to form multiple first gaps between the upper boss bodies, an airflow flowing from the wind inlet side through the upper boss bodies and the first gaps to flow out from the wind outlet side to lower a periodical noise.

25. The tray-type fan impeller structure as claimed in claim 24, wherein multiple lower boss bodies are arranged on the other face of the plate body between the wind inlet side and the wind outlet side, the lower boss bodies being arranged at intervals to form multiple second gaps between the lower boss bodies.

26. The tray-type fan impeller structure as claimed in claim 25, wherein the upper boss bodies and the lower boss bodies are arranged in identical pattern or different patterns.

27. The tray-type fan impeller structure as claimed in claim 20, wherein each upper boss body has a first free end opposite the first bottom end, a first axial height being defined between the first bottom end and the first free end of each upper boss body, the first axial heights of the respective upper boss bodies being equal to or unequal to each other.

28. The tray-type fan impeller structure as claimed in claim 24, wherein each upper boss body has a first free end opposite the first bottom end, a first axial height being defined between the first bottom end and the first free end of each upper boss body, the first axial heights of the respective upper boss bodies being equal to or unequal to each other.

* * * * *